US005712438A

United States Patent [19]

Nakata

[11] Patent Number: 5,712,438

[45] Date of Patent: Jan. 27, 1998

[54] ELECTRONIC MUSICAL INSTRUMENT WITH CLASSIFIED REGISTRATION OF TIMBRE VARIATIONS

[75] Inventor: Takuya Nakata, Hamamatsu, Japan

[73] Assignee: Yamaha Corporation, Japan

[21] Appl. No.: 549,256

[22] Filed: Oct. 27, 1995

[30] Foreign Application Priority Data

Oct. 31, 1994 [JP] Japan ..... 6-288570

[51] Int. Cl.[6] ..... G10H 1/06; G10H 1/18

[52] U.S. Cl. ..... 84/622; 84/615; 84/618

[58] Field of Search ..... 84/615–618, 622–624, 84/477 R

[56] References Cited

U.S. PATENT DOCUMENTS

| | | | |
|---|---|---|---|
| 5,171,929 | 12/1992 | Usa | 84/615 |
| 5,403,968 | 4/1995 | Sato | 84/622 |
| 5,406,023 | 4/1995 | Nagahama | 84/622 |
| 5,420,374 | 5/1995 | Hotta | 84/622 |

*Primary Examiner*—Stanley J. Witkowski
*Assistant Examiner*—Marlon T. Fletcher
*Attorney, Agent, or Firm*—Graham & James LLP

[57] ABSTRACT

A timbre information registration apparatus registers timbre variations which have different instrumental attributes and different modification degrees such that the registered timbre variations are selectively applied to instrument sounds synthesized by an electronic musical instrument. A memory has a matrix of memory locations arranged in rows and columns and assigned to individually register the timbre variations such that one timbre variation is selected by a row address and a column address. The individual timbre variations are categorized into a plurality of instrument kinds such that one instrument kind contains certain timbre variations having a common instrumental attribute. The individual timbre variations are also categorized into a plurality of version groups such that one version group contains certain timbre variations of the same modification degree. The column addresses are assigned to the respective instrument kinds such that the certain timbre variations belonging to one instrument kind are registered at the memory locations of one column. The row addresses are divided into a plurality of sections in correspondence to the plurality of the version groups such that the certain timbre variations belonging to one version group are registered at the memory locations specified by the row addresses of one section.

5 Claims, 5 Drawing Sheets

ELECTRONIC MUSICAL INSTRUMENT WITH CLASSIFIED REGISTRATION OF TIMBRE VARIATIONS

BACKGROUND OF THE INVENTION

The present invention relates to a timbre information register apparatus for registering a variety of timbres which can be selectively applied to musical sounds synthesized by an electronic musical instrument.

FIG. 5 shows a matrix arrangement of a waveform memory provided in a conventional electronic musical instrument for registering timbre information representative of basic timbres and variational timbres. In the arrangement, the plurality of the timbres are registered in a matrix of memory locations. The timbres are categorized into instrument kinds according to their instrumental attributes. Instrument kinds are assigned to columns of the matrix. The instrument kinds are designated by column addresses 0–127 such that 128 kinds of instruments are registered in the matrix at most. For example, an instrument kind of Piano is designated by column address 0, another instrument kind of is designated by column address 1, and a further instrument kind of Guitar is designated by column address 64.

On the other hand, the variational timbres are individually designated by row addresses 00H–7FH in hexadecimal notation as denoted by H. For example, 7FH in the hexadecimal notation corresponds to 127 in decimal notation. With regard to the Piano kind at the column address 0, a basic timbre Piano 1 is designated by row address 00H, another variational timbre Piano 2 is designated by row address 01H, a further variational timbre Piano K is designated by row address 3FH, and a still further variational timbre Piano M is designated by row address 7FH. In similar manner, variational timbres are designated by the row addresses for the other instrument kinds. Consequently, 127 numbers of the variational timbres can be registered at most for each instrument kind.

Recently, the electronic musical instrument is equipped with a waveform memory having a large capacity. The waveform memory registers basic timbres and variational timbres represented by various waveforms arranged in a two-dimensional matrix as shown in FIG. 5. However, increase in number of the variational timbres creates problems such that it would be difficult to manage registration and access of the timbres.

SUMMARY OF THE INVENTION

Therefore, an object of the invention is to provide a timbre information register apparatus used in an electronic musical instrument, and constructed to facilitate arrangement of timbre information in a memory matrix. The inventive apparatus registers timbre variations which have different instrumental attributes and different modification degrees such that the registered timbre variations are selectively applied to instrument sounds synthesized by an electronic musical instrument. The apparatus comprises memory means having a matrix of memory locations arranged in rows and columns and assigned to individually register the timbre variations such that one timbre variation is selected by a row address and a column address, first classification means for categorizing individual timbre variations into a plurality of instrument kinds such that one instrument kind contains certain timbre variations having a common instrumental attribute, second classification means for categorizing individual timbre variations into a plurality of version groups such that one version group contains certain timbre variations of the same modification degree, first coordination means for coordinating the column addresses to the respective instrument kinds such that the certain timbre variations belonging to one instrument and are registered at the memory locations of one column, and second coordination means for dividing the row addresses into a plurality of sections in correspondence to the plurality of the version groups such that the certain timbre variations belonging to one version group are registered at the memory locations specified by the row addresses of one section.

According to the invention, the variety of the timbre variations are classified into the plurality of the version groups according to their modification degrees or variation levels. The version groups are registered in the memory matrix a section by section. Therefore, a desired timbre variation can be readily searched and retrieved since the memory locations of the timbre variations are organized in terms of not only the instrument kind, but also the version group. The memory location of the desired timbre variation is readily identified by the column address and the row address within a section corresponding to the version group of the desired timbre variation. Further, a newly edited or created timbre variation is registered in a memory location in organized manner in terms of the instrument kind and version group of the timbre variation.

DETAILED DESCRIPTION OF THE INVENTION

Figure 1:
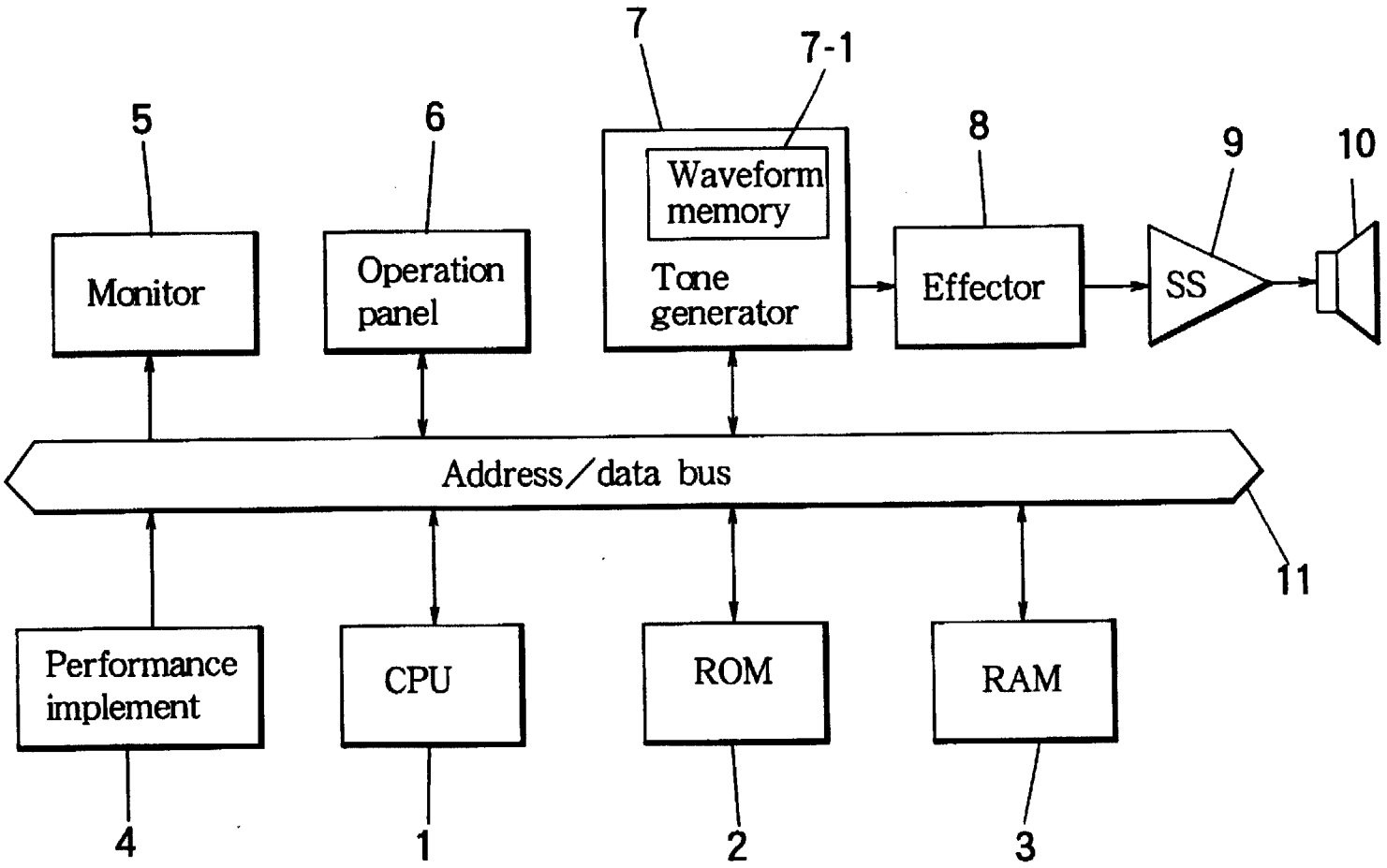
FIG. 1 is a block diagram of an electronic musical instrument including an embodiment of the inventive timbre information register apparatus.

FIG. 1 shows a block diagram of an electronic musical instrument having an embodiment of the inventive timbre information register apparatus. In the figure, the instrument includes a microcomputer (CPU) 1, a read only memory (ROM) 2, a random access memory 3, a performance implement 4 such as a keyboard, a monitor 5 and an operation panel 6. The CPU 1 executes a control program to carry out various tasks such as editing of timbres and synthesizing of a musical sound signal. The ROM 2 has memory areas for storing the program executed by the CPU 1 and for storing preset voice data and so on. The RAM 3 has a working area used by the CPU 1 during the execution of the program and a memory area for storing voice data set by a user. The monitor 5 is composed of a liquid crystal display panel or the like for displaying various messages and information. The operation panel 6 is manually actuated to designate a desired timbre of musical sounds synthesized by the electronic musical instrument, to conduct edit operation, and to set display modes.

Further, the instrument is provided with a tone generator 7 having a waveform memory 7-1. The waveform memory 7-1 is addressed to retrieve a desired waveform of a musical sound according to timbre designation information which is inputted by the user. The waveform represents a timbre variation which is applied to the music sound. The tone generator 7 has a filter unit for altering a harmonics ratio of the initial waveform retrieved from the waveform memory 7-1. The tone generator 7 further includes an envelope controller for modifying an amplitude envelope of the waveform so as to finally synthesize the musical sound. An effector 8 is connected to the tone generator 7 for imparting effects such as reverberation and tremolo to the musical sound signal fed from the tone generator 7. A sound system (SS) 9 is connected to the effector 8 and includes a volume controller for controlling and changing a mixing ratio of music sound signal components fed from plural tone generation channels and for controlling a total volume of the synthesized music sound signal. The sound system 9 further converts the digital music sound signal into a corresponding analog signal, and amplifies the analog signal. A loudspeaker 10 is connected to the sound system 9. Lastly, an address/data bus 11 is installed in the electronic musical instrument for interconnecting altogether the various components as listed above.

In the thus constructed electronic musical instrument, the musical sound synthesized by the tone generator 7 has a particular timbre variation which is selected from various timbre variations displayed on the monitor 5 by actuating the operation panel 6. Consequently, the tone generator 7 can synthesize the musical sound signal having the desired timbre variation designated by the user. Further, this instrument can edit the timbre information representative of the timbre variations stored in the waveform memory 7-1 of the tone generator 7. In such a case, the individual timbre variation to be edited is retrieved from the waveform memory 7-1 and is temporarily stored in the RAM 3. Then, the operation panel 6 is actuated to edit the timbre information stored in the RAM 3. The edited timbre information is stored back to the waveform memory 7-1.

Figure 2:
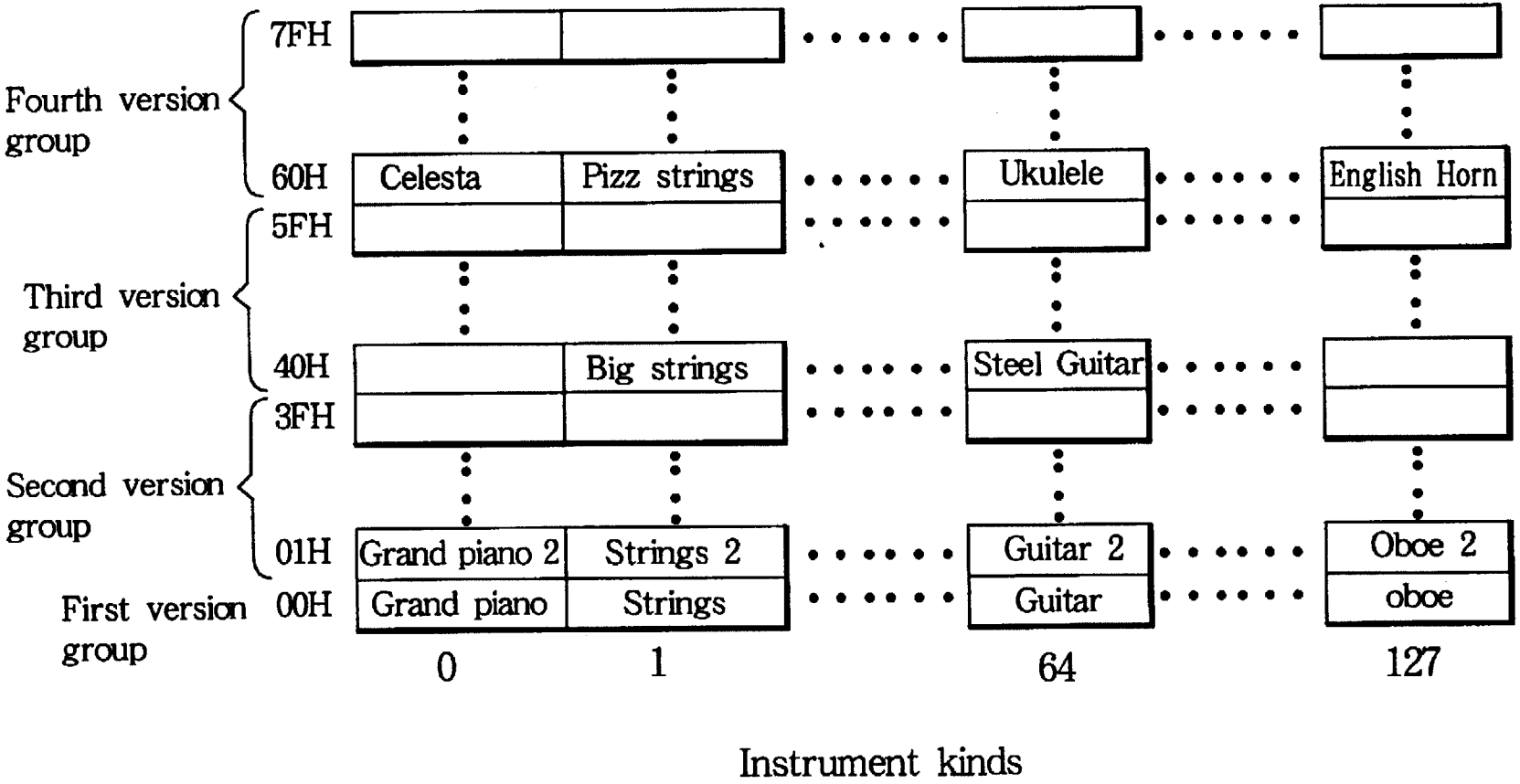
FIG. 2 is a schematic diagram showing a matrix arrangement of timbre variations in a memory of the inventive timbre information register apparatus.

FIG. 2 is a schematic diagram showing an arrangement of the timbre information registered in the waveform memory 7-1 provided in the inventive timbre information register apparatus. In the diagram, the memory has memory locations arranged in a matrix of rows and columns for individually registering the timbre variations. Instrument kinds of the timbre variations are assigned to the respective columns such that the respective instrument kinds are designated by column addresses 0–127. Further, individual timbre variations of one instrument kind are designated by row addresses 00H–7FH. The timbre variations are classified or categorized into a plurality of version groups or version layers. Namely, a first version group is a basic class containing a single basic timbre variation which is designated by the row address 00H. A second version group is a minor class containing several minor timbre variations which are designated by a section of serial row addresses 01H–3FH. Each minor timbre variation has a waveform which is identical to that of the basic timbre variation of the same instrument kind. The minor timbre variation is formed by altering timbre control parameters such as the harmonics ratio and the amplitude envelope without changing the basic or typical waveform. A third version group is a major class containing several major timbre variations which are designated by another section of row addresses 40H–5FH. Each major timbre variation is formed by changing or altering the basic waveform. A fourth version group is a distinctive class containing several distinctive timbre versions designated by a further section of row addresses 60H–7FH. Each distinctive timbre variation represents a different instrument species but belongs to the same instrument kind or genus as the basic timbre variation.

As shown in the matrix arrangement, the first version group or basic layer contains at most 128 number of basic timbre variations which represent the respective instrument kinds. Each instrument kind contains at most 127 numbers of minor, major and extra-major or distinctive variations of the basic timbre. In detail, the first column address 0 is assigned to an instrument kind labeled by a typical timbre Grand Piano. The second column address 1 is assigned to another instrument kind labeled by a typical timbre Strings. The further column address 64 is assigned to a further instrument kind labeled by a typical timbre Guitar. The last column address 127 is assigned to a still further instrument kind represented by a typical timbre Oboe. On the other hand, the various timbre variations of the basic timbre are registered a section by section at one column of the memory locations. For example, with regard to the timbre variations of the Grand Piano kind, the first section of the row addresses 01H–3FH is assigned to the minor version group including a minor timbre variation Grand Piano 2 and so on, which is formed by altering filter characteristics of the tone generator or other parameters while maintaining the basic waveform. The second section of the row addresses 40H–5FH is assigned to the major version group to register a major timbre variation Electric piano and so on, which is formed by altering or changing the basic waveform. The third section of the row addresses 60H–7FH is assigned to the distinctive or separate version group to register distinctive timbre variations such as Celesta which is a different species than a piano species but belongs to the same instrument genus.

As described above, the inventive timbre information registering apparatus registers the variety of the timbre variations which have different instrumental attributes which simulate Piano, Strings, Guitar, Oboe and so on, and which have different modification degrees such as minor and major variations. The waveform memory 7-1 has a matrix of memory locations which are arranged in rows and columns and which are allocated to individually register the variety of the timbre variations such that one timbre variation is selected in terms of the row addresses 00H–7FH and the column addresses 0–127. The individual timbre variations are categorized into the plurality of the instrument kinds such as Piano, Strings, Guitar and Oboe such that one instrument kind contains similar timbre variations having a common instrumental attribute. The individual timbre variations are also categorized by a different manner into the plurality of the basic, minor, major and distinctive version groups such that one version group contains timbre variations of the same modification degree. The column addresses 1–127 are coordinated to the respective instrument kinds such that the instrumentally similar timbre variations belonging to one instrument kind are registered at the memory locations of one column. The row addresses 00H–7FH are divided into the four sections 00H, 01H–3FH, 40H–5FH and 60H–7FH in correspondence to the four version groups. Therefore, certain timbre variations belonging to one version group are registered at the memory locations specified by the serial row addresses of one section.

Figure 3:
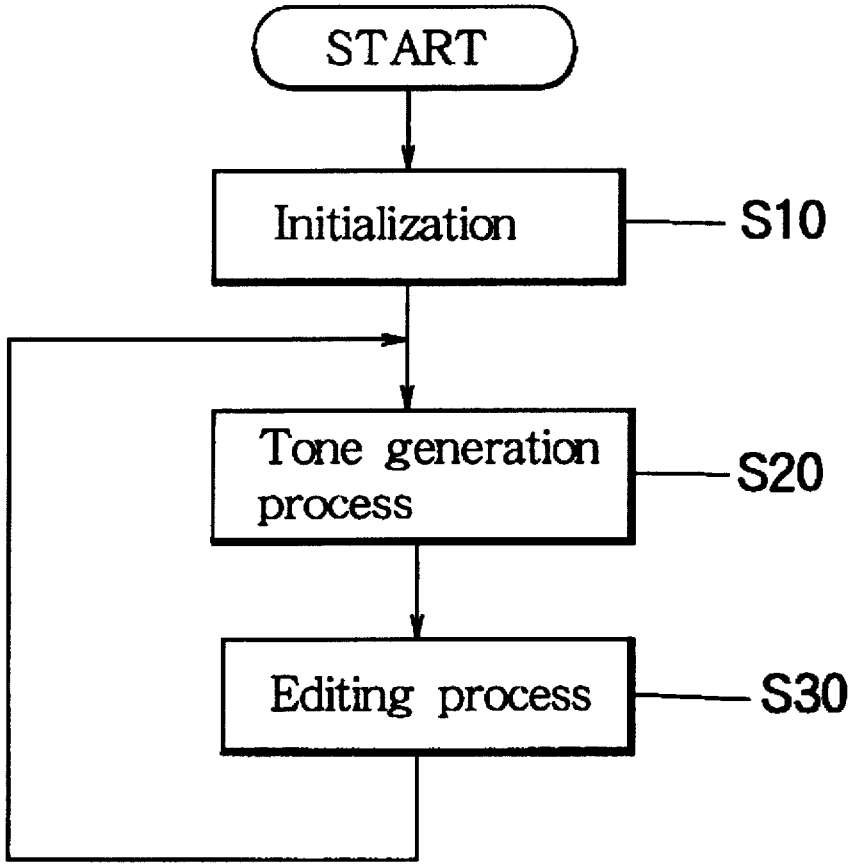
FIG. 3 is a flow chart showing a main routine executed by the electronic musical instrument shown in FIG. 1.

FIG. 3 is a flow chart of a main routine executed by the electronic musical instrument including the inventive timbre information register apparatus. When the main routine is initiated upon turning on of a power source of the electronic musical instrument, Step S10 is undertaken to initialize various registers. Then, Step S20 is undertaken to carry out tone generation process including key-on and key-off processes. Further, Step S30 is undertaken to carry out editing process such that timbre information is edited and registered at an appropriate memory location of the register apparatus as shown in FIG. 2. The routine of the Steps S20 and S30 is repeatedly executed in cyclic manner.

Figure 4:
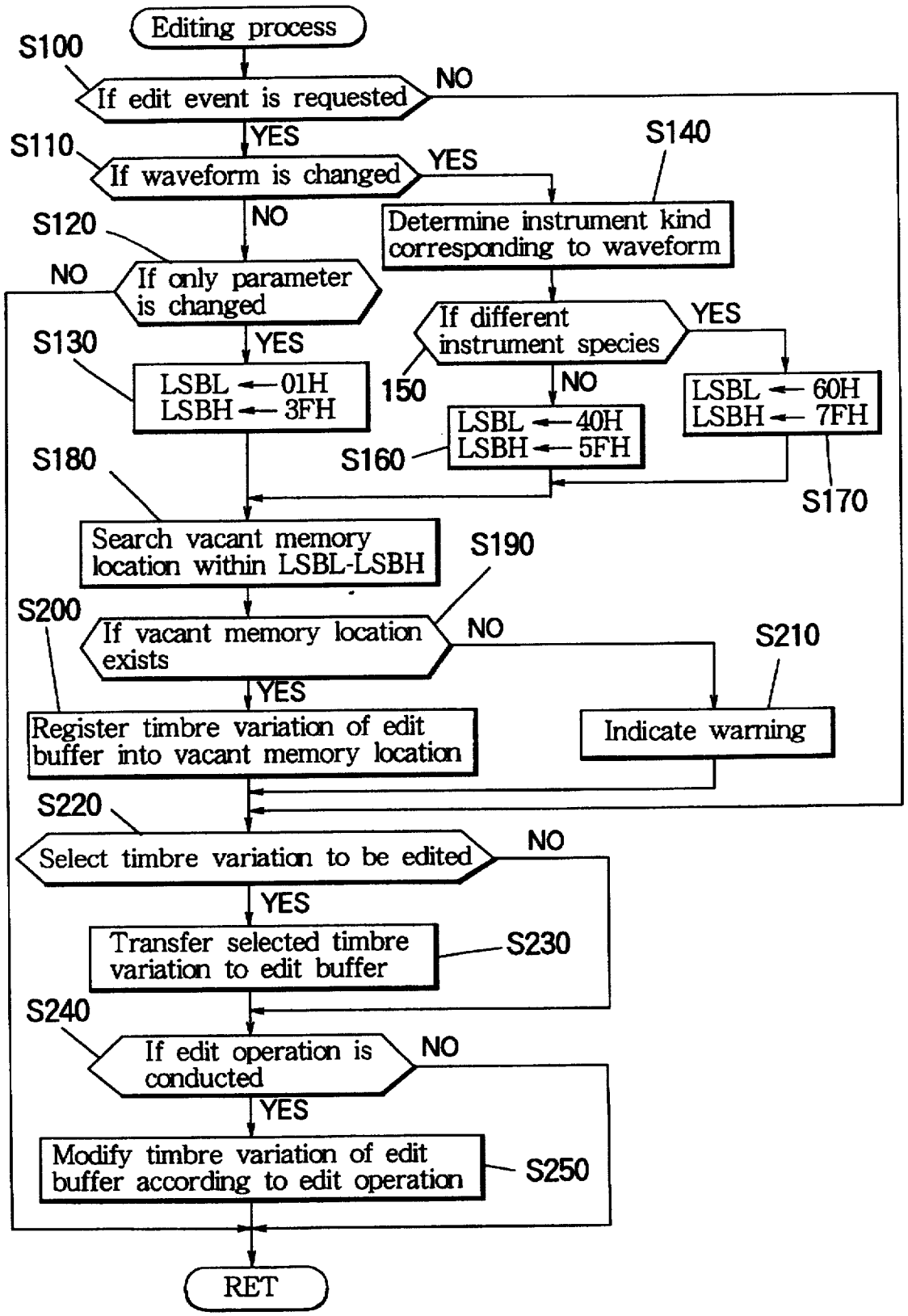
FIG. 4 is a flow chart showing an editing process carried out by the inventive timbre information register apparatus.
Figure 5:
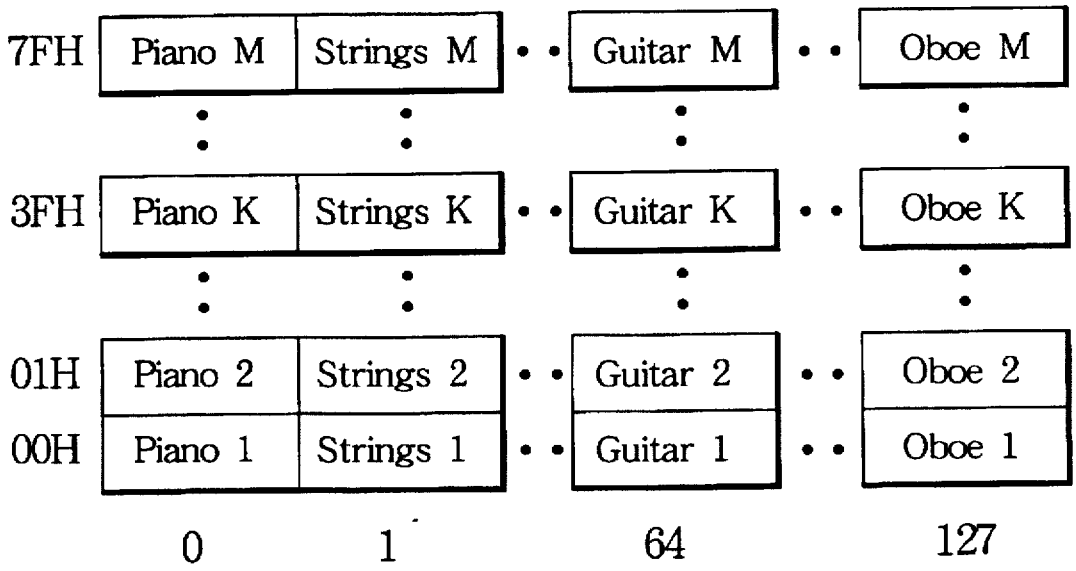
FIG.5 PRIOR ART
FIG. 5 is a schematic diagram showing a conventional matrix arrangement of timbre variations.

Referring to FIG. 4, detailed description is given for the editing process executed in the Step S30. Upon start of the editing process, first check is made at Step S100 as to if an edit event is requested to modify or alter an old timbre variation to a new timbre variation. If YES, next check is made at Step S110 as to if a waveform of the old timbre variation is to be changed. If YES, Step S140 is undertaken to ask the user as to which of instrument kinds corresponds to the changed waveform to thereby determine a right instrument kind. Further, check is made in Step S150 as to if the changed waveform belongs to a different instrument species than a typical waveform of a basic timbre. If YES, a lower limit row address LSBL is set to 60H and an upper limit row address LSBH is set to 7FH since the edited timbre variation is classified to the distinctive version group. Thereafter, the routine proceeds to Step S180. On the other hand, if the Step S100 judges that the edit event is not requested, the routine jumps to Step S220.

If the Step S150 judges that the edited timbre variation does not belong to a different instrument species, Step S160 is undertaken to set the lower limit row address LSBL with 40H and to set the upper limit row address LSBH with 5FH, thereby advancing to Step S180. In this case, the edited timbre version is classified to the major version group.

If the Step S110 judges that the waveform is not changed, subsequent check is made at Step S120 as to if only parameters are changed or altered. If YES, Step S130 is undertaken to set the lower limit row address LSBL with 01H and to set the upper limit row address LSBH with 3FH, thereby advancing to the Step S180. In this case, the edited timbre variation belongs to the minor version group. On the other hand, if the Step S120 judges that parameters are not changed, no editing operation is effected to thereby simply return since the edit event is inadvertently requested.

In the Step S180, a vacant memory location is searched within the address section between LSBL and LSBH. If Step S190 judges that there is a vacant memory location which does not yet store a timbre variation, the new timbre variation stored in an edit buffer is registered into the searched vacant memory location in Step S200. If the Step S190 judges that there is no vacant memory location, Step S210 is undertaken to indicate warning on the monitor 5 that the edited timbre variation is not registered since there is no vacant memory location.

Separate check is made in Step S220 as to if a timbre variation to be edited is designated. If YES, the designated or selected timbre variation is retrieved from the memory according to the row and column addresses, and is then transferred to the edit buffer in Step S230. Thereafter, the routine advances to Step S240. If the Step S220 judges that timbre selection is not requested, the routine directly advances to the Step S240.

Further check is made in the Step S240 as to if edit operation is effected. If YES, the timbre variation stored in the edit buffer is modified or updated according to the edit operation in Step S250, thereby returning.

By such a manner, the editing process is conducted stepwise including the registration steps, the timbre selection steps and the editing steps of changing a waveform itself or parameters related to an envelope and a harmonics rate of the waveform. In the actual editing process, a selected timbre variation is read out from the waveform memory 7-1 and is then transferred to the edit buffer in a first cycle of the FIG. 4 routine. The timbre variation stored in the edit buffer is subjected to the edit operation in a second cycle of the FIG. 4 routine. The edited timbre variation is classified and registered into an adequate memory location of the waveform memory in a third cycle of the FIG. 4 routine. Alternatively, a waveform sampled by a microphone may be edited and registered instead of selecting waveforms stored in the memory. The inventive timbre information register is integrated into the electronic musical instrument. Otherwise, the inventive timbre information register apparatus may be used alone as a master memory for producing a waveform memory built in the electronic musical instrument. The inventive timbre information register apparatus is useful as it is since the variety of the timbre variations determined by waveform data and parameter data are automatically registered in the memory in categorized or organized manner.

As described above, according to the invention, the timbre variations registered in the matrix of the memory locations are categorized into the plurality of the version groups according to their modification degree or variation level. Therefore, a desired timbre variation is readily searched and retrieved from the matrix of the memory location. Further, a newly created or edited timbre variation is registered in an adequate memory location in classified or organized manner to thereby facilitate management of the timbre information.

What is claimed is:

1. An apparatus for storing timbres, including basic timbres and variations of the basic timbres, comprising:

memory means having a matrix of memory locations arranged in rows and columns for storing the timbres such that each timbre is selected by a row address and a column address;

first classification means for categorizing individual timbres into a plurality of instrument kinds such that each instrument kind contains at least one basic timbre and a plurality of variations of the basic timbre all having a common instrumental attribute type;

second classification means for categorizing basic timbres into a basic timbre group and individual variations of the basic timbres into a plurality of version groups such that each version group contains timbres that differ from the basic timbre by a similar degree;

first coordination means for assigning each instrument kind to a particular column of said matrix so that all timbres belonging to a particular instrument kind are stored in the column assigned to the particular instrument kind; and second coordination means for assigning the basic timbre group to at least one row and each version group to a particular group of rows so that all basic timbres are stored in the at least one row assigned to the basic timbre group and all timbres belonging to a particular version group are stored in the rows assigned to the particular version group.

2. An apparatus according to claim 1, wherein the plurality of version groups include a minor version group containing minor timbre variations which are moderately modified relative to the basic timbres, and a major version group containing major timbre variations which are significantly modified relative to the basic timbres.

3. An apparatus according to claim 1, wherein the plurality of version groups include a first version group containing minor variations of the basic timbres whose waveforms do not differ from waveforms of the basic timbres, a second version group containing major variations of the basic timbres that belong to the same instrument species as the basic timbres and whose waveforms differ from the waveforms of the basic timbres, and a third version group containing distinctive variations of the basic timbres belonging to a same instrument genus as the basic timbres but a different instrument species.

4. An apparatus according to claim 1 further comprising:

selecting means for selecting a timbre having a particular instrumental attribute type and degree of difference from the basic timbres;

editing means for editing the selected timbre; and storing means for storing said edited timbre in a memory location corresponding to the instrumental attribute and degree of difference from a basic timbre of the edited timbre.

5. A method for editing timbres stored in a matrix of memory cells in which all timbres having a particular one of a plurality of instrumental attribute types are stored in a particular column of said matrix, and all timbres having a particular one of a plurality of variation degrees relative to a basic group of timbres are stored in a particular group of rows of said matrix, said method comprising:

selecting and reading one of said timbres stored in said matrix of memory cells;

editing said selected timbre to produce an edited timbre;

determining an instrumental attribute type of said edited timbre and a column of said matrix that corresponds to said determined instrumental attribute type;

determining a variation degree of said edited timbre relative to a basic timbre having said determined instrumental attribute type and a group of rows of said matrix that correspond to said determined variation degree;

searching for a vacant memory cell corresponding to said determined column and said determined group of rows of said matrix; and if a vacant memory cell is found, writing said edited timbre to said vacant memory cell.

* * * * *